US006779601B2

(12) United States Patent
Wilson et al.

(10) Patent No.: US 6,779,601 B2
(45) Date of Patent: Aug. 24, 2004

(54) INFLATABLE PACKING ELEMENT

(75) Inventors: Paul J. Wilson, Houston, TX (US); Corey E. Hoffman, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 27 days.

(21) Appl. No.: 10/346,015

(22) Filed: Jan. 15, 2003

(65) Prior Publication Data

US 2003/0131988 A1 Jul. 17, 2003

Related U.S. Application Data

(60) Provisional application No. 60/350,183, filed on Jan. 16, 2002.

(51) Int. Cl.[7] ..... E21B 33/127

(52) U.S. Cl. ..... 166/187; 166/118; 166/120; 166/122; 166/387; 277/331; 277/334

(58) Field of Search ..... 166/187, 387, 166/120, 122, 118; 277/334, 331

(56) References Cited

U.S. PATENT DOCUMENTS

| | | | | |
|---|---|---|---|---|
| 4,424,861 A | | 1/1984 | Carter, Jr. et al. | |
| 4,892,144 A | | 1/1990 | Coone | |
| 4,923,007 A | * | 5/1990 | Sanford et al. | 277/334 |
| 5,495,892 A | * | 3/1996 | Carisella | 166/387 |
| 5,718,292 A | | 2/1998 | Heathman et al. | |
| 5,720,343 A | | 2/1998 | Kilgore et al. | |
| 5,775,429 A | | 7/1998 | Arizmendi et al. | |
| 5,813,459 A | | 9/1998 | Carisella | |
| 6,116,339 A | | 9/2000 | Milne et al. | |
| 6,209,636 B1 | | 4/2001 | Roberts et al. | |
| 6,223,820 B1 | | 5/2001 | Carisella | |
| 6,253,856 B1 | | 7/2001 | Ingram et al. | |
| 6,257,339 B1 | | 7/2001 | Haugen et al. | |
| 6,269,878 B1 | | 8/2001 | Wyatt et al. | |
| 6,341,654 B1 | | 1/2002 | Wilson et al. | |
| 6,431,273 B1 | | 8/2002 | McGarian et al. | |
| 6,431,274 B1 | | 8/2002 | Nowlin et al. | |

FOREIGN PATENT DOCUMENTS

GB 2 320 734 7/1998 ..... E21B/33/127

OTHER PUBLICATIONS

PCT Search Report, International Application No. PCT/US 03/01181, dated Jun. 13, 2003.

* cited by examiner

*Primary Examiner*—David Bagnell
*Assistant Examiner*—Giovanna M. Collins
(74) *Attorney, Agent, or Firm*—Moser, Patterson & Sheridan, L.L.P.

(57) ABSTRACT

An inflatable packing element for a bridge plug. The packing element has an anchor portion and a sealing cover portion, each of which is expanded in order to engage and seal a surrounding string of casing or borehole. The anchor portion has a minimum length defined by 2.63× the inner diameter of the surrounding pipe or other wellbore opening. At the same time, the anchor portion has a maximum length defined by approximately 49% of the length of the expanded portion of the packing element engaging the surrounding pipe or other wellbore opening.

19 Claims, 5 Drawing Sheets

INFLATABLE PACKING ELEMENT

RELATED APPLICATIONS

This new application for letters patent claims priority from an earlier-filed provisional patent application entitled "Inflatable Packer Element." That application was filed on Jan. 16, 2002 and was assigned Application No. 60/350,183.

BACKGROUND OF THE INVENTION

1. Field of the Invention

The present invention generally relates to downhole tools for use in a wellbore. More particularly, the invention relates to a downhole tool for sealing a wellbore, such as a hydrocarbon wellbore. More particularly still, the invention relates to an inflatable sealing element for a downhole tool used for sealing a hydrocarbon wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

After a well has been drilled and completed, it is desirable to provide a flow path for hydrocarbons from the surrounding formation into the newly formed wellbore. To accomplish this, perforations are shot through the liner string at a depth which equates to the anticipated depth of hydrocarbons. Alternatively, a liner having pre-formed slots may be run into the hole as casing. Alternatively still, a lower portion of the wellbore may remain uncased so that the formation and fluids residing therein remain exposed to the wellbore.

When a wellbore is completed, the wellbore is opened for production. In some instances, a string of production tubing is run into the wellbore to facilitate the flow of hydrocarbons to the surface. In this instance, it is common to deploy one or more packers within the tubing string in order to seal the annular region defined between the tubing and the surrounding string of casing. In this way, a producing zone within the wellbore is isolated.

Various types of packers may be utilized. One common type of packer is an inflatable packer. Inflatable packers employ an elongated bladder that is inflated using a working fluid or well fluids. Inflation may be accomplished either by injecting fluid into the borehole from the surface, or through actuation of a downhole pump.

Inflatable packers are commonly used to seal the annular space around a string of production tubing in order to direct the flow of production fluids up the bore of the tubing and to the surface. However, inflatable packers may be used for many other purposes during the life of a well. For example, an inflatable well packer may be used to seal the annulus between a liner string and a surrounding string of casing during well completion. They may be used to support a column of cement above a lost circulation zone. They may also be used to isolate producing zones from cement contact during a cement squeeze job.

An inflatable packer may also be used to affect a complete seal of a tubular bore at a selected depth in a wellbore. In this instance, the inflatable packer is more commonly known as a bridge plug. In some instances, a bridge plug may be used to permanently plug a well after production operations have ceased. In other instances, a wellbore may be temporarily plugged so that formation treatment operations may be conducted. For example, a bridge plug may be set at a depth below a production zone within the casing. A formation treating operation can then be conducted above the bridge plug by injecting gel and sand, under pressure, into the formation. Still other uses for packers are also known, including dual use as an anchor.

For purposes of this disclosure, the term "bridge plug" will be used to refer to and to include any downhole tool which includes an expandable bladder as part of a sealing element, or "packing element." This includes devices having a throughbore that would more commonly be considered "packers."

The bladder in a typical inflatable bridge plug is surrounded by two separate expandable cover portions. The first cover portion is an expandable anchor; the second cover portion is an expandable sealing cover. Together, the bladder and the two surrounding cover portions make up a "packing element."

First, the expandable anchor portion of a packing element serves to frictionally engage the surrounding case or, as the case may be, the raw borehole. Typically, the anchor portion defines a series of vertically overlaid reinforcing straps that are exposed to the surrounding casing. The straps are aligned along the linear plane of the tool so as to essentially run the length of the packing element. At the same time, the straps are placed radially around the bladder in a tightly overlapping fashion. For this reason, the straps are sometimes referred to as "lapped steel ribs". The ends of the metal straps are welded together and are secured to end collars. One end collar defines a slidable sub which permits that end to be drawn up as the reinforcing straps are expanded. Upon expansion, the straps engage the surrounding pipe, serving to anchor the bridge plug within the wellbore. Sufficient straps are employed so that as the bladder expands the straps, the straps do not completely separate, but retain the bladder therein.

As an alternative to the use of metal straps, woven or braided steel cable may be used. In the case of a braided cable reinforcement, a closed tube of braided material is secured at opposite ends to packer end collars. A compression assembly is provided between a pair of conical clamping surfaces for securing the cables. In some cases, the end attachment of braided reinforcement is supplemented by injection of an epoxy polymer between the interstices of cable and the conical clamping surfaces.

As noted, the second cover portion of the inflatable bridge plug is the expandable sealing cover. The sealing cover defines a pliable material which surrounds a portion of the reinforcing straps (or other anchor portion). As the bladder and straps are expanded, the sealing cover expands and engages the surrounding pipe in order to effectuate a fluid seal. Thus, the anchor portion and the sealing cover portion of the packing element combine to effectuate a setting and sealing function for the bridge plug.

Inflatable bridge plugs enjoy certain advantages over mechanically set bridge plugs/packers. Primarily, inflatable bridge plugs are advantageous in the context of high expansion operations. In this respect, most inflatable bridge plugs are capable of achieving a higher expansion ratio than mechanically set bridge plugs and packers. Those of ordinary skill in the art will understand that the expansion ratio is defined by the ratio of the inside diameter of the surrounding pipe to the original outside diameter, i.e., running diameter, of the packing element. However, high expansion applications (typically those greater than 2.25:1) place challenges on the designer to balance the anchoring and sealing capabilities of the packing element. In this regard, a trade-off oftentimes occurs in the design of a bridge plug between a high sealing capability and a high anchoring capability. A higher expansion ratio typically affords a greater anchoring capacity for the straps; in contrast, a lower expansion ratio provides for a weaker anchoring contact between the straps and the surrounding pipe.

In an effort to accomplish both a strong anchoring function and a strong sealing function for an inflatable bridge plug, designers have offered various configurations for the packing element. For example, in one arrangement an elongated sealing cover is provided, with the sealing cover being open or "exposed" central to the anchor. In this arrangement, the anchor portion is located in the center of the packing element. However, because the anchor portion is short relative to the sealing cover portion, this arrangement compromises the maximum anchoring capability of the bridge plug. In this respect, due to the shape change that occurs in the element under load, the short anchor in the center of the element will not distribute the applied differential load through the anchor to the pipe wall as efficiently as an anchor placed toward the end of the packing element. The shape change can occur because the inner mandrel within the bladder and the control valve tends to "float" along the central line of the packing element, allowing the bottom of the packing element to slide along the mandrel. Contact to the pipe wall is made via the reinforcing metal strap and rubber cover. As load is applied to the packing element from below, the element can bunch up. In contrast, as load is applied from above, the element tends to morph from a circular cylinder shape to a teardrop shape. Hence, the metal reinforcing straps do not uniformly bite into the surrounding pipe. However, this arrangement does provide an optimum seal with the surrounding pipe wall due to the long rubber cover on either side of the anchor.

In an effort to overcome the problem of the short center anchor, some have offered a long anchor located in the center of the packing element. Typically, a long anchor would be a length in excess of 20 inches. This longer anchor will provide a stronger grip with the surrounding pipe. However, the sealing efficiency is reduced due to the shorter cover lengths on either side of the exposed reinforcing straps.

Another arrangement for the packing element which has been designed offers two long anchors on opposite ends of the packing element, with a short sealing cover in the middle. This arrangement provides an acceptable bi-directional anchor for reinforcing the surrounding pipe. However, this dual anchor design tends to capture fluid between the two anchoring ends as they expand, preventing full expansion of the intermediate sealing cover. The short cover is sometimes an ineffective seal as it allows fluid to bypass between the reinforcing straps and the underside of the cover. In addition, strap buckling can occur within the reinforcing straps as they expand, causing a catastrophic failure of the bridge plug.

To overcome this problem, packing elements have been offered utilizing only a single anchor portion and a single sealing cover portion. In one known arrangement, a short anchor is placed at one end of the packing element, and a longer sealing cover is maintained at the opposite end of the packing element. However, a short anchor biased to one end of the packing element will not grip the surrounding pipe sufficiently to prevent sliding of the bridge plug at the maximum designed differential pressure unless higher initial inflation pressures are used. Further, a short anchor is less effective in low expansion applications.

As can be seen, an improved packing element for an inflatable bridge plug is needed. More specifically, a packing element is needed which employs a longer anchoring portion which is biased at one end of the bladder. Further, a need exists for an inflatable packing element which maximizes both the anchoring and sealing functions of an inflatable bridge plug.

SUMMARY OF THE INVENTION

The present invention provides an inflatable packing element for use on a bridge plug. In the packing element of the present invention, an expandable anchoring portion is placed at one end of the packing element, while a pliable, expandable sealing cover portion is placed at the opposite end of the packing element. The length of the anchor portion is longer than in known inflatable bridge plugs wherein the anchor is biased to one end. The increased anchor length serves to insure that the inflatable bridge plug will not slide after being set within casing at low expansion ratios, as well as at higher expansion ratios (up to and in excess of 3:1).

The length of the anchor is determined by a novel calculation which considers the coefficient of friction between the reinforcing straps of the anchoring portion and the surrounding pipe wall. The calculation also considers the area of pipe contact as well as contact pressure generated from the bladder of the bridge plug. The length of the anchor portion upon expansion is at least approximately 2.63× the inner diameter of the opening of the wellbore, e.g., surrounding casing. At the same time, the length of the anchor portion is no greater upon expansion than approximately 49% of the total length of the expanded packing element, that is, the length of the anchor portion engaging the surrounding wellbore opening plus the length of the sealing cover portion engaging the surrounding wellbore opening.

It is desired, though not required, that a pliable cover ring be placed around the welded metal straps of the anchor portion at one end, and the sealing cover portion be circumferentially disposed around the anchor portion at an opposite end.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only certain embodiments of this invention and are therefore not to be considered limiting of its scope, for the invention may admit to other equally effective embodiments.

DETAILED DESCRIPTION OF THE PREFERRED EMBODIMENT

Figure 1:
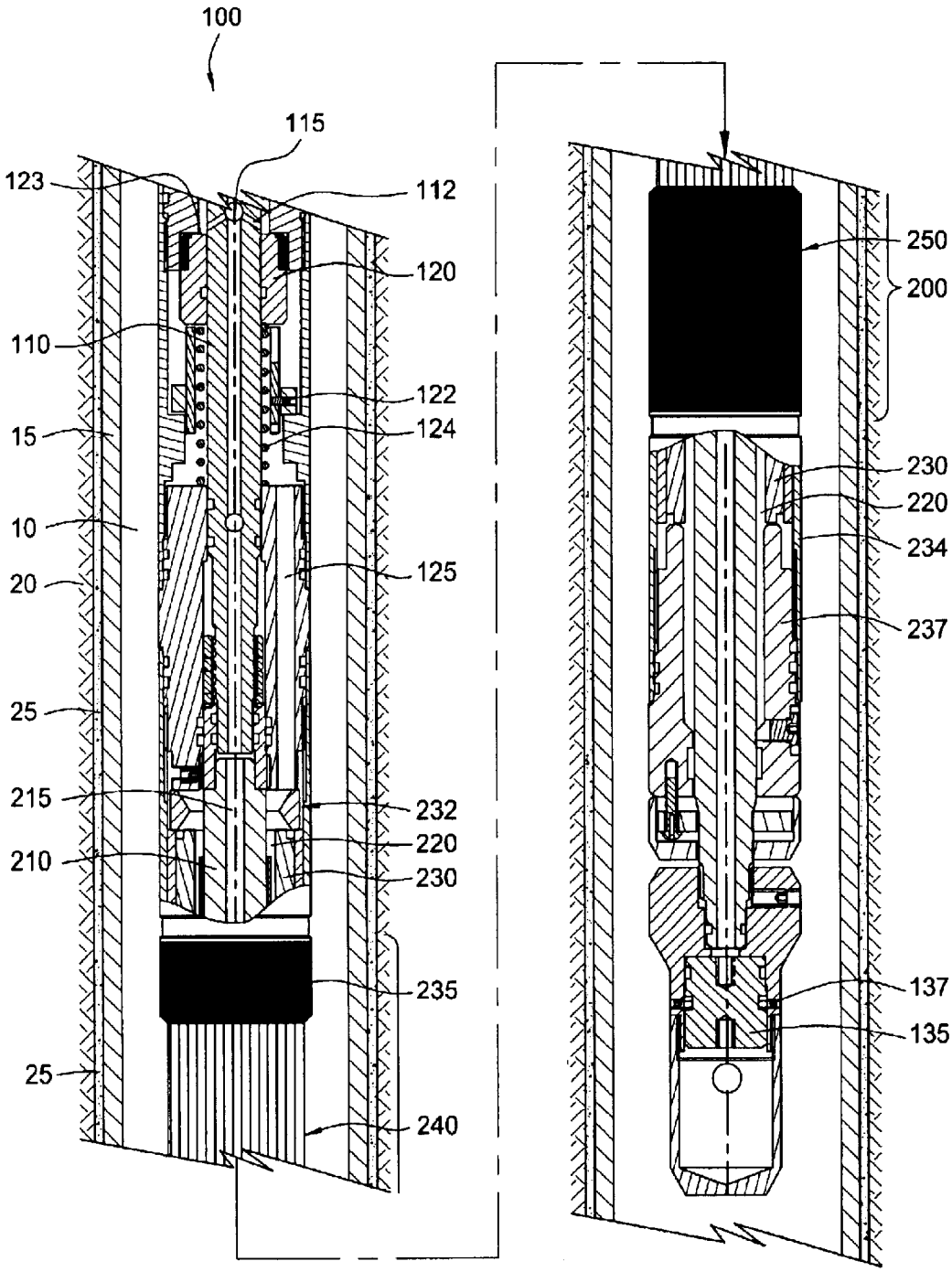
FIG. 1 presents a partial cross-sectional view of a bridge plug. The bridge plug is disposed within a portion of a cased wellbore. The bridge plug includes an inflatable packing element of the present invention. The inflatable packing element is seen in side view in an uninflated state.

FIG. 1 presents a partial cross-sectional view of a bridge plug 100. The bridge plug 100 includes an inflatable packing element 200 of the present invention, in one embodiment. The inflatable sealing element 200 is seen in side view. In the view of FIG. 1, the sealing element 200 has not yet been inflated.

Figure 2:
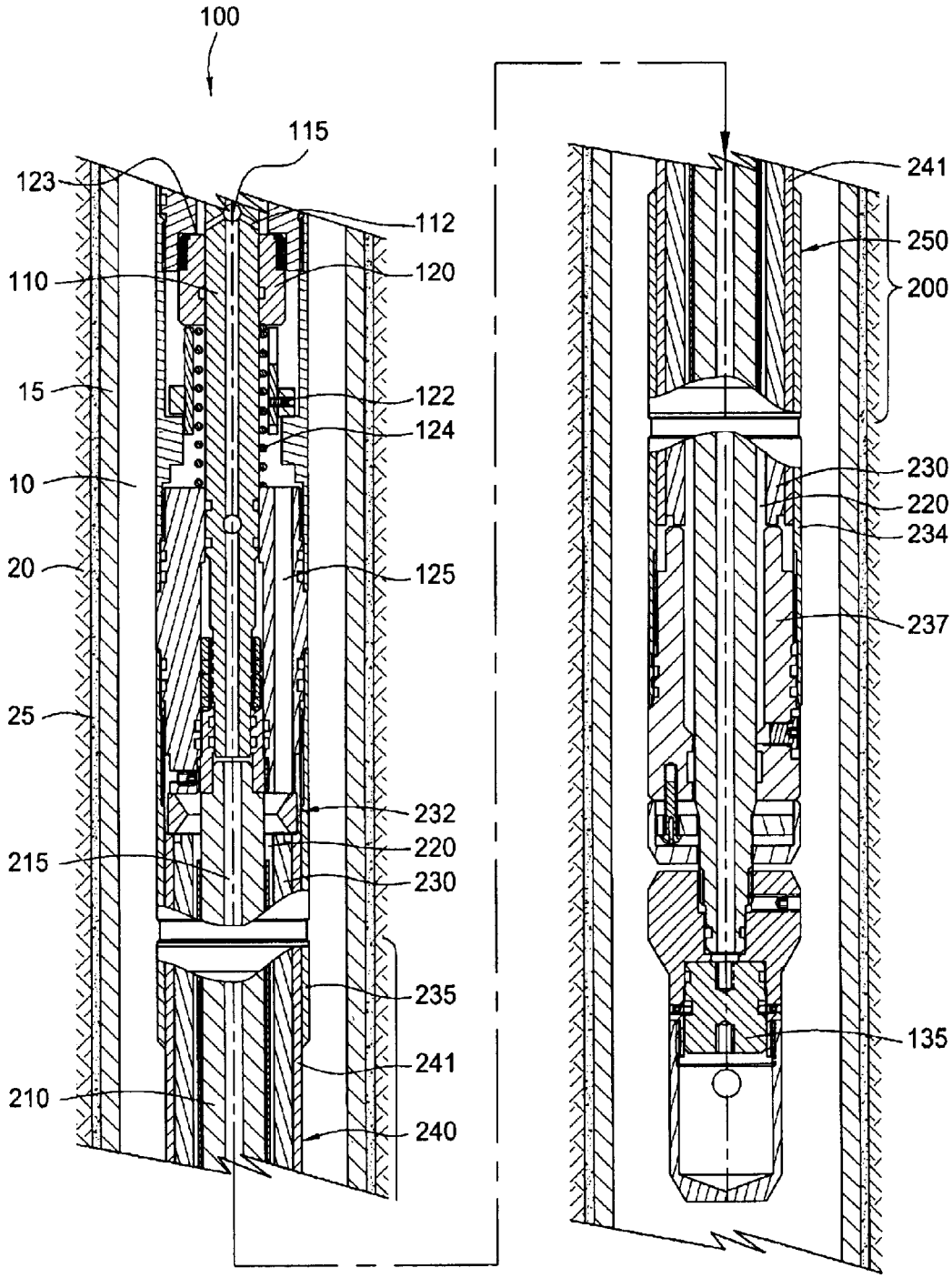
FIG. 2 presents a cross-sectional view of the bridge plug of FIG. 1. Here, the inflatable packing element is seen in cross-section. The packing element is again uninflated.

FIG. 2 presents a cross-sectional view of the bridge plug 100 of FIG. 1. Here, the same inflatable packing element 200 is seen in cross-section. The packing element 200 is again in its uninflated state.

The bridge plug 100 of FIGS. 1 and 2 has been run into a wellbore 10. It can be seen that the wellbore 10 has been cased with a string of casing 15. The casing 15 has been set within the surrounding formation 20 of the wellbore 10. Cured cement 25 is seen in the annular region between the casing 15 and the surrounding earth formation 20.

The bridge plug 100 of FIGS. 1 and 2 has been run into the wellbore 10 on a working string (not shown). The working string may be any type of run-in string, including but not limited to wireline, slickline, fiberoptic cable, drill pipe or coiled tubing. It is understood that a releasing tool or releasing mechanism (not shown) is typically employed in order to release the bridge plug 100 from the working string after the bridge plug 100 has been set within the wellbore 10.

The bridge plug 100 of FIGS. 1 and 2 includes various parts used for setting the packing element 200 within the surrounding pipe 15. An actuating system is provided in the upper portion of the tool 100 that acts in response to hydraulic pressure. First, an actuation mandrel 110 is disposed centrally within an upper portion of the bridge plug 100. The actuation mandrel 110 defines a tubular body having a bore 115 therein. The mandrel 110 receives fluid used for actuating the packing element 200. Coaxially disposed around the central bore 115 of the plug 100 is a valve 120. The valve 120 selectively permits fluid communication between the central bore 115 of the bridge plug 100 and the packing element 200 below. Initially, the valve 120 is held in a closed position by a shearable connection 122. An additional spring member 124 serves to bias the valve 120 in its closed position. In FIGS. 1 and 2, the valve 120 is shown in the closed position, with the shearable connection 122 intact.

The valve 120 is designed to open in response to a predetermined pressure that is sufficient to overcome the shearable connection 122 and the biasing force of the spring 124. The predetermined pressure is applied to a column of fluid within the above running string (not shown). Pressurized fluid acts upon an upper surface 123 of the annularly shaped valve 120 until the shearable connection 122 holding the valve 120 in the open position fails. Thereafter, the fluid pressure moves the valve 120 downward against spring member 124. This opens a path for fluid under pressure to travel into an upper annular region 125 of the tool 100.

Figure 3:
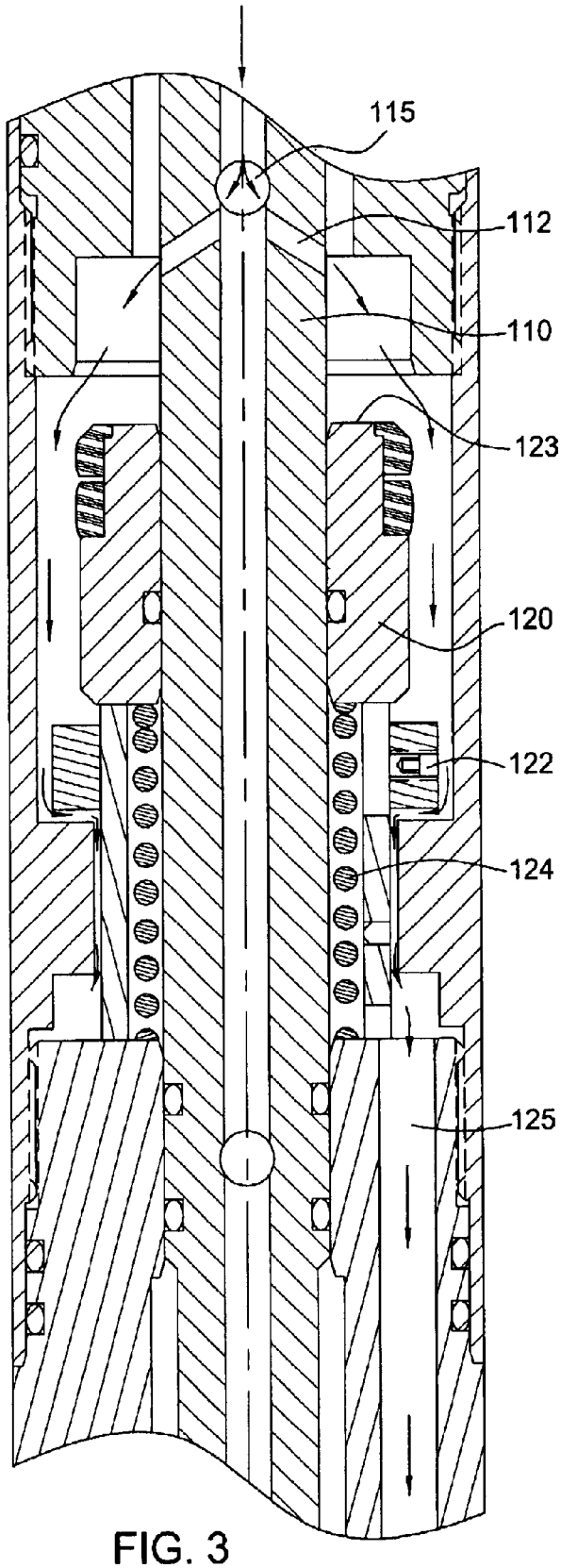
FIG. 3 is an enlarged view of an upper portion of the bridge plug of FIGS. 1 and 2. In this view, the path of fluid for actuating the bridge plug is more clearly seen, with arrows depicting the fluid path.

FIG. 3 presents an enlarged view of an upper portion of the bridge plug 100 of FIGS. 1 and 2. In FIG. 3, the resistive forces of the spring 124 have been overcome and the shearable connection 122 holding the valve 120 in the open position has sheared. This allows fluid to flow through a port 112 (shown in FIG. 3) in the actuation mandrel 110 and around the valve 120. Fluid then flows into the upper annular region 125. Arrows are provided to illustrate the path of fluid from the central bore 115 of the actuation mandrel 110 to the upper annular region 125 of the tool 100.

Returning to FIG. 2, below the actuation mandrel 110 is an inner bridge plug mandrel 210. The bridge plug mandrel 210 defines a tubular body which runs the length of the packing element 200. A bore 215 is defined within the bridge plug mandrel 210. Further, an annular region 220 is defined by the space between the outer wall of the bridge plug mandrel 210 and a surrounding packing element 200. The annular region 220 of the packing element 200 receives fluid from the upper annular region 125 of the bridge plug 100 when the packing element 200 is actuated. This serves as the mechanism for expanding the packing element 200 into a set position within the casing 15, as will be described below.

Figure 4:
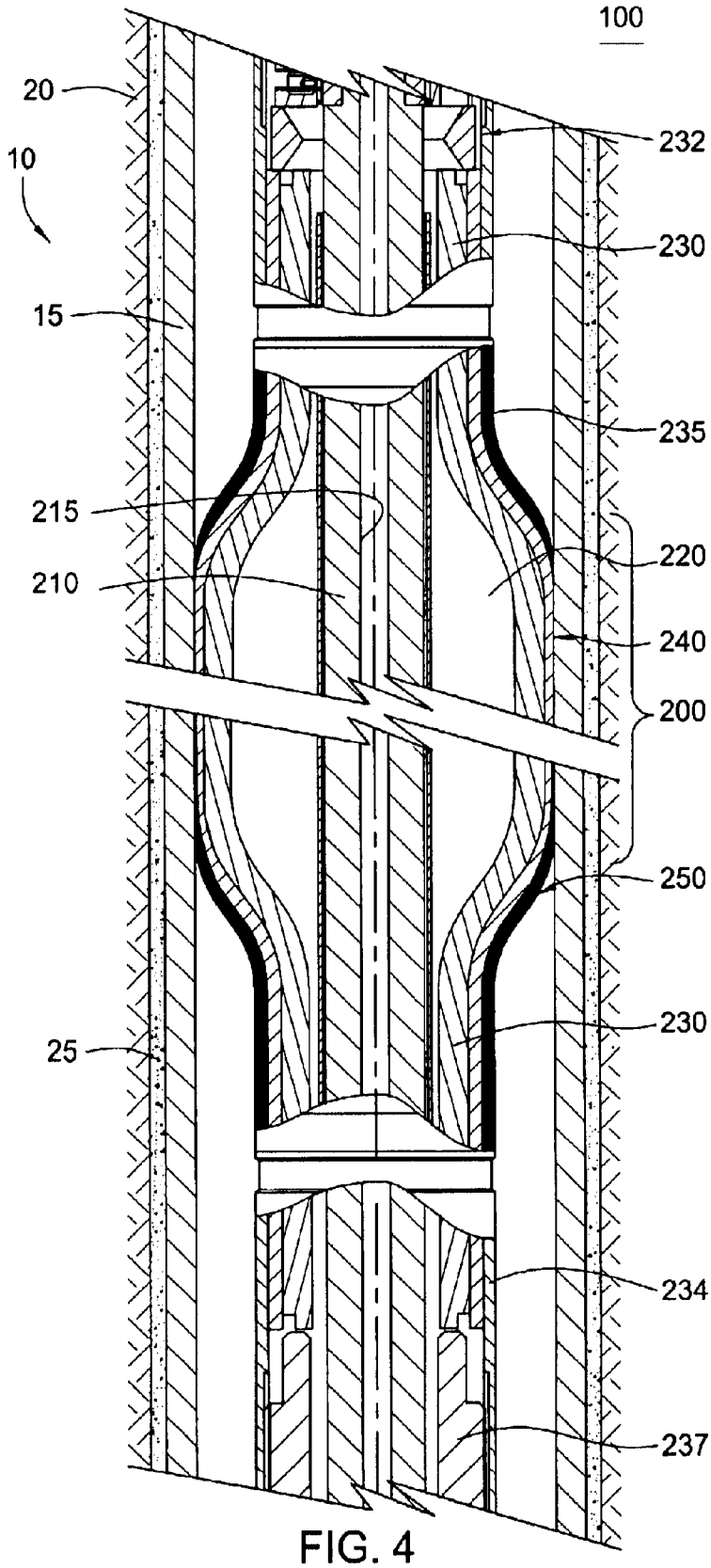
FIG. 4 presents a cross-sectional view of an enlarged portion of the packing element of FIG. 1. In this view, the anchor portion and sealing cover portion of the packing element are more clearly seen. The packing element has been inflated.

FIG. 4 presents an enlarged cross-sectional view of a packing element 200 of the present invention. In this view, the packing element has been expanded into contact with a surrounding string of casing 15. To accomplish this, fluid has been injected through the valve 120 (shown in FIG. 3), through the upper annular region 125, and into the annulus 220 of the packing element 200. Fluid continues to flow downward through the tool 100 until it is blocked at a lower end by a plug member 135 (seen in FIG. 2). The plug member 135 is held in a first plugged position within the interior of the bridge plug 100 by a separate shearable connection 137. In this way, sufficient fluid pressure is allowed to build up in order to expand the packing element 200.

The plug member 135 (seen in FIGS. 1 and 2) is capable of being moved to a second open position in response to a higher fluid pressure. This allows the setting fluid to flow through the annulus 220 and to release pressure within the packing element 200. In the view of FIGS. 1 and 2, the plug 135 is shown in the first position before the shearable connection 137 has failed. Likewise, in the view of FIGS. 4 and 5, the plug 135 has not yet moved downward to permit fluid to flow out of the lower end of the bridge plug 100. The packing element 200 is thus held in its inflated state.

The parts of the packing element 200 of the present invention are best seen in the cross-sectional view of FIG. 4. First, an elongated bladder 230 is seen. The bladder 230 is disposed circumferentially around the inner mandrel 210 of the bridge plug 100. The bladder 230 is fabricated from an elastomeric or other pliable material. The bladder 230 is connected at opposite ends to end connectors 232 and 234. In the arrangement shown in FIG. 4, the upper end connector 232 is fixed ring, meaning that the upper end of the packing element 200 is stationary with respect to the inflatable tool 200. However, the lower end connector 234 is connected to a slidable sub 237. The slidable sub 237, in turn, is movable along the bridge plug mandrel 210. This permits the bladder 230 and other packing element 200 parts to freely expand outwardly in response to the injection of fluid into the annular region 220 between the bridge plug mandrel 210 and the bladder 230. In this view, the lower end connector 234 has moved upward along the bridge plug mandrel 210, thereby allowing the packing element 200 to be inflated.

Also visible in FIG. 4 is an anchor portion 240 of the packing element 200. The anchor portion 240 in one aspect is fabricated from a series of reinforcing straps 241 (not shown individually) that are radially disposed around the bladder 230. The straps 241 are aligned along the linear plane of the tool 100 so as to essentially run the length of the packing element 200. At the same time, the straps 241 are placed radially around the bladder 230 in a tightly overlapping fashion. Preferably, the straps 241 are fabricated from a metal alloy. However, other materials suitable for engaging a surrounding steel pipe 15 (or earth formation) may be used, such as ceramic or other hardened composite. It is understood that the present invention is not limited to the method of fabrication used for the anchor portion 240. Indeed, a plurality of ceramic ribs or other materials may be employed as well. The straps 241 are arranged to substantially overlap one another in a radial array. A sufficient number of straps 241 are used for the anchor portion 240 to retain the bladder 230 therein as the anchor portion 240 expands.

The metal straps 241 are fixedly connected at opposite first and second ends. In one aspect, the strap ends are connected by welding. The ends of the straps 241 are welded (or otherwise connected) to the upper 232 and lower 234 end connectors, respectively.

The anchor portion 240 is not defined by the entire length of the straps 241; rather, the anchor portion 240 represents only that portion of the straps 241 intermediate the end connectors 232, 234 that is exposed, and can directly engage a surrounding wellbore opening, e.g., casing 15. In this respect, in the preferred embodiment, a length of the straps 241 is covered by a sealing cover portion 250.

The packing element 200 of FIG. 4 shows the sealing cover portion 250. The sealing cover portion 250 is shown in cross-section in FIG. 4; it is shown in side view in FIG. 1. The sealing cover portion 250 defines a pliable cover placed over the bladder 230. In the preferred arrangement, the cover portion 250 is also placed over a selected length of the metal straps 241 at one end. Where a cover ring 235 is employed, the sealing cover portion 250 is placed over the straps 241 (or other anchoring material) at the end opposite the cover ring 235. The sealing cover portion 250 provides a fluid seal when the packing element 200 is expanded into contact with the surrounding inner diameter of the pipe 15.

The sealing cover 250 is fabricated from a material suitable for the service environment in which the bridge plug 100 is to be operated. Factors to be considered when selecting a sealing cover material include the chemicals likely to contact the cover 250, the prolonged impact of hydrocarbon contact on the cover 250, the presence and concentration of corrosive compounds such as hydrogen sulfide or chlorine within the wellbore 10, and the pressure and temperature at which the cover 250 must operate. In a preferred embodiment, the cover 250 is fabricated from an elastomeric material. However, non-elastomeric materials or polymers may be employed as well, so long as they substantially prevent production fluids from passing upwardly between the outer surface of the inflated bridge plug 100 and the inner surface of the surrounding string of pipe, e.g., casing 15, or the formation.

In one arrangement, the pliable cover 250 is fabricated from a unique composition suitable for expanding in response to an inflated bladder. The composition comprises a specially blended nitrile base compound designed to maintain compound properties at elevated temperatures. Again, however, pliable materials that do not include a nitrile base may be employed, such as a fluoroelastomer.

The pliable sealing cover 250 used in the typical bridge plug 100 is substantially uniform in thickness. The sealing cover 250 for the packing element 200 of the preset invention may also be uniform in thickness, both radially and axially. However, in one unique arrangement for the packing element 200 of the present invention, the sealing cover 250 employs a non-uniform thickness. In one aspect, the thickness of the sealing cover 250 is tapered so as to gradually increase in thickness as the cover 250 approaches the anchor portion 240. In one aspect, the taper is cut along a constant angle, such as 3 degrees. In another aspect, the thickness of the cover 250 is variable in accordance with the undulating design of Carisella, discussed in U.S. Pat. No. 6,223,820, issued May 1, 2001. The '820 Carisella patent is incorporated in its entirety herein by reference. The variable thickness cover reduces the likelihood of folding within the bladder 230 during expansion. This is because the variable thickness allows some sections of the cover element 250 to expand faster than other sections, causing the overall exterior of the element 200 to expand in unison.

Figure 5:
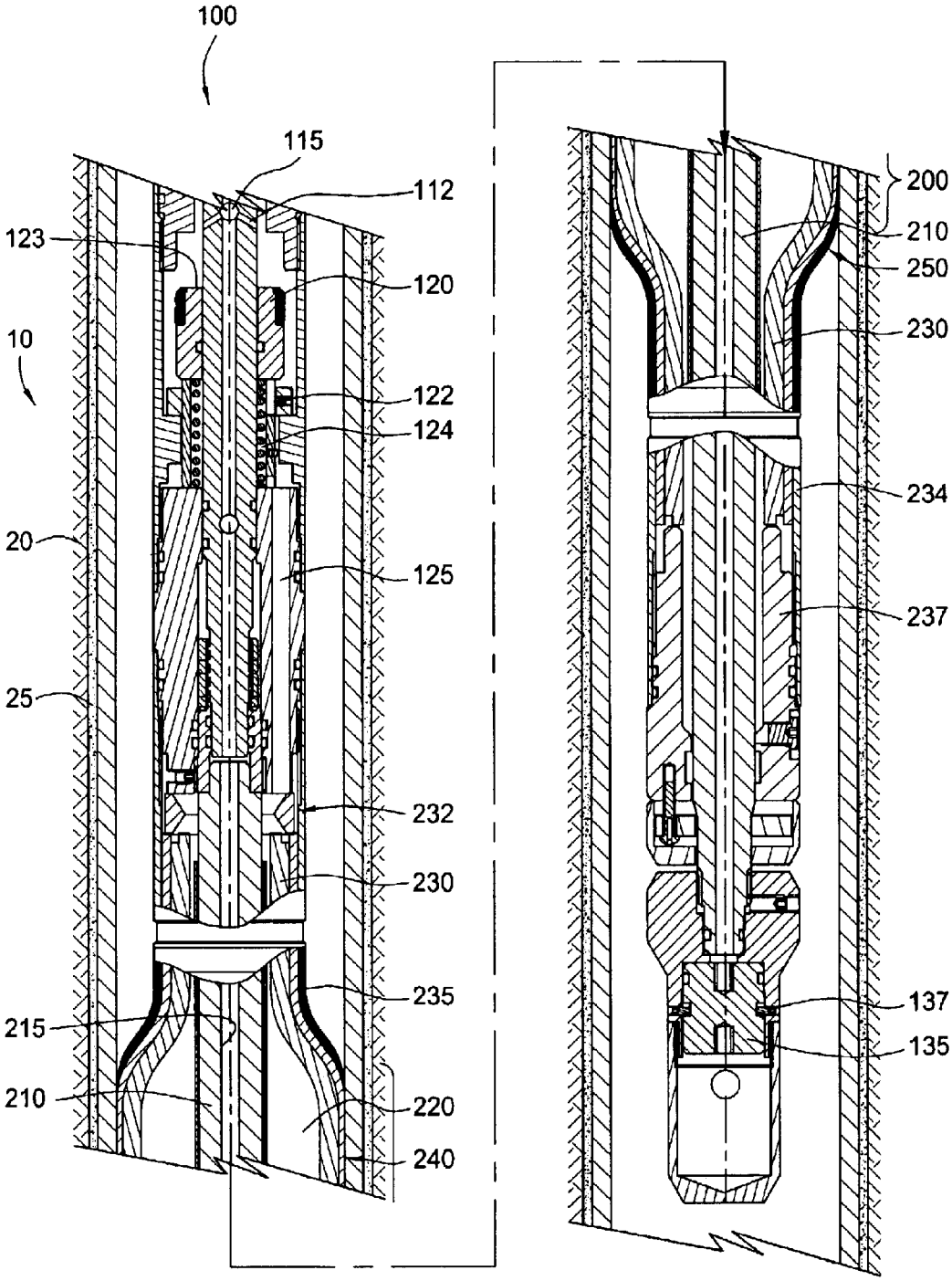
FIG. 5 presents a cross-sectional view of the bridge plug of FIG. 1. In this view, the bridge plug is being actuated so as to expand the packing element into frictional and sealing engagement with the surrounding pipe wall. It can be seen that both the anchor portion and the sealing portion of the packing element are in contact with the surrounding tubular.

FIG. 5 demonstrates the bridge plug 100 of FIGS. 1 and 2, in its actuated state. This means that the anchor portion 240 and sealing cover portion 250 of the packing element 200 have been expanded into frictional and sealing engagement, respectively, with the surrounding casing 15 (or borehole). As the bladder 230 is expanded, the exposed portion of straps 241 that define the anchor portion 240 frictionally engages the surrounding pipe 15 in order to set the bridge plug 100. Likewise, expansion of the bladder 230 also expands the sealing cover portion 250 into engagement with the surrounding bore. The bridge plug 100 is thus both frictionally and sealingly set within the wellbore 10.

It should be noted at this point that the packing element 200 as shown in FIGS. 1, 2, 4 and 5 may be used as the inflatable element for any inflatable bridge plug 100 or packer. In this respect, those of ordinary skill in the art will appreciate that there are numerous ways for actuating an inflatable element. The present invention is not limited to any particular means or apparatus for actuating the packing element 200, or to any particular type of inflatable bridge plug or packer, but is directed to the packing element 200 itself. Thus, the bridge plug 100 shown in FIGS. 1–5 is merely exemplary for purposes of disclosure to one of ordinary skill in the art.

A cover ring 235 is optionally disposed at one end of the anchor portion 240. The cover ring 235 defines a short elastomeric tubular member which serves to retain the welded metal straps 241 at one end of the anchor portion 240. The cover ring 235 typically does not serve a sealing function with the surrounding pipe 15 or other wellbore opening. This is particularly true when the bridge plug 100 is inflated in a "maximum i.d." hole for the design of the tool 100. In that instance, a very small portion of the cover ring 235, if any, even engages the surrounding borehole. The length of the cover ring is preferably less than the outer diameter of the inflation element's 200 running diameter.

In the arrangement for packing element 200 of FIG. 4, the cover ring 235 is seen proximate to the upper end connector 232. However, it is understood that the cover ring 235 may be disposed at either end of the anchor portion 240 so long as it is opposite the sealing cover portion 250.

The inflatable element 200 of the present invention presents a novel relative configuration for the anchor portion 240 and the sealing cover portion 250. First, the anchor portion 240 is biased to one end of the packing element 200. Thus, the anchor portion 240 is disposed at one end of the packing element 200, while the sealing cover portion 250 is disposed at the other end of the packing element 200. It is, of course, understood that the packing element 200 may include a cover ring 235 at the end of the packing element 200 opposite the sealing cover portion 250. However, the cover ring 235 is not substantially inflated, and serves neither an anchoring function nor a sealing function, but primarily exists to help bind the welded straps 241 together opposite the sealing cover portion 250.

The sealing cover 250 is disposed circumferentially around a section of the reinforcing straps 241 opposite the cover ring 235. Preferably, the cover 250 is bonded to the adjacent straps on the inner surface of the cover 250. This means that the reinforcing straps 241 (or other anchoring material) are covered at one end and do not engage the surrounding wellbore opening. However, the straps are exposed at the end opposite the cover 250 to define the anchor portion 240.

The anchor portion 240 has a defined minimum and maximum length. For purposes of the present invention, the anchor portion 240 is defined as the expanded length of straps 241 (or other anchoring material) that is not covered by the sealing cover 250 and engages the surrounding casing or borehole upon expansion. In the event some portion of the cover ring 235 also engages the surrounding borehole upon inflation of the bladder 230, then that incidental portion of the cover ring 235 is included in the definition of the expanded anchor portion 240.

The minimum length of the anchor portion 240 is defined by a mathematical formula. The anchor length 240 is based upon the formula of 2.63× the inside diameter of the surrounding pipe 15 (or formation) in which the inflatable packer 100 is to be set. By way of example, a calculation can be made for the minimum overall length of the anchor portion 240 of a packing element 200 for a 2⅛" bridge plug. A 2⅛" inflation element can be set in 7 inch casing. The inner diameter for a typical 7 inch casing is 6⅜". Thus, the approximate minimum anchor length 240 for the 2⅛" inflatable element upon expansion would be:

$$2.63\times6.375=16.766 \text{ inches.}$$

This means that in this example, at least 16.766 inches of anchoring material/cover ring must engage the surrounding wellbore opening upon expansion. Packing elements which are larger than 2⅛" in running diameter may be set in larger wellbores and will have anchor portions longer than 16.77".

As for the maximum length, the maximum length of the expanded anchor portion 240 does not encompass more than approximately 49% of the overall length of the packing element 200 upon expansion. In this regard, the anchor portion 240 does not extend beyond the center of the packing element 200 after the packing element is expanded. For purposes of this disclosure, the length of the expanded packing element 200 is generally defined as the length of the sealing cover portion 250 engaging the surrounding wellbore opening, plus the length of the anchor portion 240 (including any part of the cover ring 235) that engages the surrounding wellbore opening.

It is again noted that the ends of the internal ribs or straps 241 are connected to end connectors 232, 234. These end portions do not expand and are not included in the calculation for the length of the packing element 200 for purposes of this invention. For example, in one arrangement for the inflatable element 200 of the present invention, the length of the straps 241 from weld-to-weld is 56 inches. However, the length of the straps urging the packing element 200 to engage the surrounding wellbore is only 44.5 inches. The sealing cover portion 250 covers a length of these 44.5 inches of expanded straps at one end. According to the present invention, the anchor portion 240, i.e., exposed portion of straps 241 engaging the surrounding wellbore upon expansion, can be no longer than approximately 21.8 inches. Where the tool 100 is set in 7 inch casing (6.375-inch inner diameter), the anchor portion 240 must provide at least 16.77 inches of anchoring material engaging the surrounding wellbore opening.

The inflatable sealing element 200 of the present invention has utility in either cased hole or open hole completions. It may also be utilized within tubing, perforated casing or slotted liner.

What is claimed is:

1. An inflatable packing element for sealing an opening within a wellbore, the opening having an essentially circular cross-section defining an inner diameter, the packing element comprising:

an inflatable anchor portion;

an inflatable sealing cover portion, wherein the length of the anchor portion engaging the inner diameter upon expansion is at least approximately 2.63× the inner diameter of the opening of the wellbore; and wherein the anchor portion engaging the inner diameter is no greater in length upon expansion than approximately 49% of the total length defined by the length of the anchor portion engaging the surrounding wellbore opening plus the length of the sealing cover portion engaging the surrounding wellbore opening.

2. The inflatable packing element of claim 1, wherein:

the inflatable anchor portion is fabricated from a plurality of overlaid reinforcing straps arranged in a radial array; and the inflatable sealing cover portion is fabricated from a pliable material.

3. The inflatable packing element of claim 2, wherein:

the plurality of reinforcing straps of the anchor portion have a first end and second end;

the inflatable sealing cover portion is disposed around the plurality of the reinforcing straps proximate to the second end of the reinforcing straps, but leaving the reinforcing straps exposed proximate to the first end of the reinforcing straps; and the exposed section of reinforcing straps defining the anchor portion.

4. The inflatable packing element of claim 3, wherein the reinforcing straps are fabricated from a metal alloy.

5. The inflatable packing element of claim 4, wherein the reinforcing straps are fabricated from a ceramic material.

6. The inflatable packing element of claim 5, wherein the reinforcing straps are fabricated from a composite material.

7. The inflatable packing element of claim 1, wherein the inflatable sealing cover portion has a variable thickness to allow some sections of the inflatable sealing cover portion to expand faster than other sections, thereby causing the inflatable sealing cover portion to expand in unison.

8. The inflatable packing element off claim 7, wherein the inflatable sealing cover portion is fabricated from an elastomeric material.

9. The inflatable packing element of claim 1, further comprising an elongated inflatable bladder, the bladder residing essentially concentrically within the anchor portion and the sealing cover portion of the packing element so as to urge the anchor portion and the sealing cover portion outwardly upon inflation of the bladder.

10. The inflatable packing element of claim 1, wherein the opening within the wellbore is defined by a string of casing.

11. The inflatable packing element of claim 1, wherein the opening within the wellbore is defined by the formation.

12. The inflatable packing element of claim 1, wherein the opening within the wellbore is defined by a string of production tubing.

13. An inflatable packing element for sealing a pipe within a wellbore, the pipe having an essentially circular profile defining an inner diameter, the packing element comprising:

an elongated inflatable bladder having a first end and a second end;

a plurality of overlaying metal straps disposed in a radial array, the metal straps having first ends proximate to the first end of the bladder, and second ends proximate to the second end of the bladder, and the plurality of metal straps being disposed circumferentially around the bladder and being outwardly expandable upon inflation of the bladder, a cover ring disposed circumferentially around the plurality of metal straps proximate to the respective first ends of the metal straps, an inflatable sealing cover portion disposed radially around the plurality of metal straps proximate to the respective second ends of the metal straps, and leaving a section of the plurality of metal straps exposed between the cover ring and the sealing cover portion so as to define an anchor portion;

wherein the anchor portion has a minimum length upon expansion defined by 2.63× the inner diameter of the pipe; and wherein the anchor portion has a maximum length defined by no more than approximately 49% of (1) the length of the inflated sealing cover portion engaging the surrounding pipe, plus (2) the length of the inflated anchor portion engaging the surrounding pipe, plus (3) the length of the cover ring engaging the surrounding pipe, if any, upon full expansion of the bladder.

14. The inflatable packing element of claim 13, wherein the surrounding pipe is a string of casing.

15. The packing element of claim 13, wherein the inflatable sealing cover portion is fabricated from a pliable elastomeric material.

16. The packing element of claim 15, wherein the thickness of the inflatable sealing cover portion is non-uniform.

17. The packing element of claim 15, wherein the thickness of the inflatable sealing cover portion is tapered to increase as the sealing cover portion approaches the anchor portion.

18. The packing element of claim 15, wherein the thickness of the sealing cover portion varies along the length of the sealing cover portion to allow some sections of the sealing covered portion to expand faster than other sections, thereby causing the exterior of the sealing cover portion to expand essentially in unison.

19. The packing element of claim 13, wherein the inflatable bladder is molded.

* * * * *